United States Patent [19]

Welles

[11] Patent Number: 4,861,957

[45] Date of Patent: Aug. 29, 1989

[54] MICROWAVE PACKAGE WITH PINHOLE VENTS

[75] Inventor: Theodore W. Welles, Pepper Pike, Ohio

[73] Assignee: The Moser Bag and Paper Company, Cleveland, Ohio

[21] Appl. No.: 225,728

[22] Filed: Jul. 28, 1988

[51] Int. Cl.[4] ..... H05B 6/80; B65B 25/22

[52] U.S. Cl. ..... 219/10.55 E; 426/107; 426/113; 426/118; 426/243; 229/905; 229/DIG. 14; 383/100; 99/DIG. 14

[58] Field of Search ..... 219/10.55 E, 10.55 F; 99/451, DIG. 14; 426/107, 113, 118, 234, 243, 552; 220/367, DIG. 27; 229/87 B, 903, DIG. 14; 383/45, 88, 100, 102, 103

[56] References Cited

U.S. PATENT DOCUMENTS

| | | | |
|---|---|---|---|
| 4,015,085 | 3/1977 | Woods | 219/10.55 E |
| 4,268,738 | 5/1981 | Flautt, Jr. et al. | 219/10.55 F |
| 4,363,851 | 12/1982 | Mishina et al. | 428/333 |
| 4,404,241 | 9/1983 | Mueller et al. | 428/35 |
| 4,553,010 | 11/1985 | Bohrer et al. | 219/10.55 E |
| 4,567,341 | 1/1986 | Brown | 219/10.55 E |
| 4,590,078 | 5/1986 | Umina | 426/113 |
| 4,599,275 | 7/1986 | Hayashi et al. | 428/461 |
| 4,678,882 | 7/1987 | Bohrer et al. | 219/10.55 E |
| 4,713,510 | 12/1987 | Quick et al. | 219/10.55 E |
| 4,720,410 | 1/1988 | Lundquist et al. | 428/136 |

*Primary Examiner*—A. D. Pellinen
*Assistant Examiner*—David Osborn
*Attorney, Agent, or Firm*—Fay, Sharpe, Beall, Fagan, Minnich & McKee

[57] ABSTRACT

A package for microwave heating of food products includes a multi-layer sheet material having a first paper layer defining an exterior portion of the assembled package. A metallized polyester is laminated to the paper layer and defines the interior portion of the assembled package. A plurality of pinholes extend completely through the sheet material. Peripheral regions of the sheet material are left free of any pinholes to receive an adhesive for securing the sheet material to itself and form the completed package. Absence of the pinholes inhibits passage of the adhesive to the interior of the assembled package.

8 Claims, 2 Drawing Sheets

MICROWAVE PACKAGE WITH PINHOLE VENTS

BACKGROUND OF THE INVENTION

This invention pertains to the art of food packaging, and more particularly to packages adapted for microwave ovens.

The invention is particularly applicable to a multi-layer sheet material having a large number of small pinholes for cooking bread products and will be described with particular reference thereto. However, it will be appreciated that the invention has broader applications and may be employed in cooking other food products.

U.S. Pat. No. 4,404,241 to Mueller, et al. issued Sept. 13, 1983 and is generally representative of the current state of the art in microwave food packaging. Additionally, this patent provides a concise explanation of some of the problems involved with packaging foods for cooking in microwave ovens. Specifically, Mueller, et al. teaches use of a single, one inch diameter circular aperture or four, ¼ inch diameter apertures in a sidewall of a package to release or vent built-up water vapor or steam during heating or cooking. Although these aperture sizes adequately vent the package to limit pillowing or rupture, the enlarged openings do cause variations in the texture of the cooked product in the package. Bread products in particular have a tendency to become tough and overcooked at areas disposed adjacent these apertures and soft or undercooked at areas spaced away from the apertures.

Still other microwave packages utilize an adhesive to secure different portions of the package together. Although adequately securing the package, the adhesive may become liquid-like during microwave heating and enter vent openings in the package to contaminate the food product.

It is also generally known to employ microwave packaging of a multi-layer material in which one layer that forms the interior of the package s a metal. It is important to control the thickness of the metal layer since too great a thickness will tend to short out the microwave while a correct, predetermined deposit will facilitate heating. Again, provisions have previously been made to vent packages of this type to prevent rupturing or pillowing as a result of the vapor pressure that builds up during cooking. The large openings often utilized in structures of this type have the effect of unevenly cooking the food product.

The subject invention is deemed to provide a new and improved arrangement that overcomes the above referenced problems and others, and provides an improved package structure that evenly cooks a food product.

SUMMARY OF THE INVENTION

In accordance with the present invention, a multi-layer sheet material is provided having pinholes for venting and evenly cooking an enclosed food product.

According to another aspect of the invention, the pinholes extend completely through the sheet material in a first region and are absent from the sheet material in a peripheral, second region. Means for securing the sheet material is disposed only along the peripheral second region to inhibit passage of the securing means through the pinholes to the food product.

According to a further aspect of the invention, the multi-layer material includes a first paper layer defining an exterior portion of the assembled package and a metallic layer defining an interior portion of the assembled package.

In accordance with still another aspect of the invention, the pinholes are approximately 0.01 inches in diameter.

A primary advantage of the invention resides in the ability to evenly cook a bread product in a microwave oven.

Another advantage of the invention is found in the ability to adequately vent the package during cooking.

Yet another advantage of the invention is provided by the pinhole arrangement which limits the potential for an adhesive adulterating the food product.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
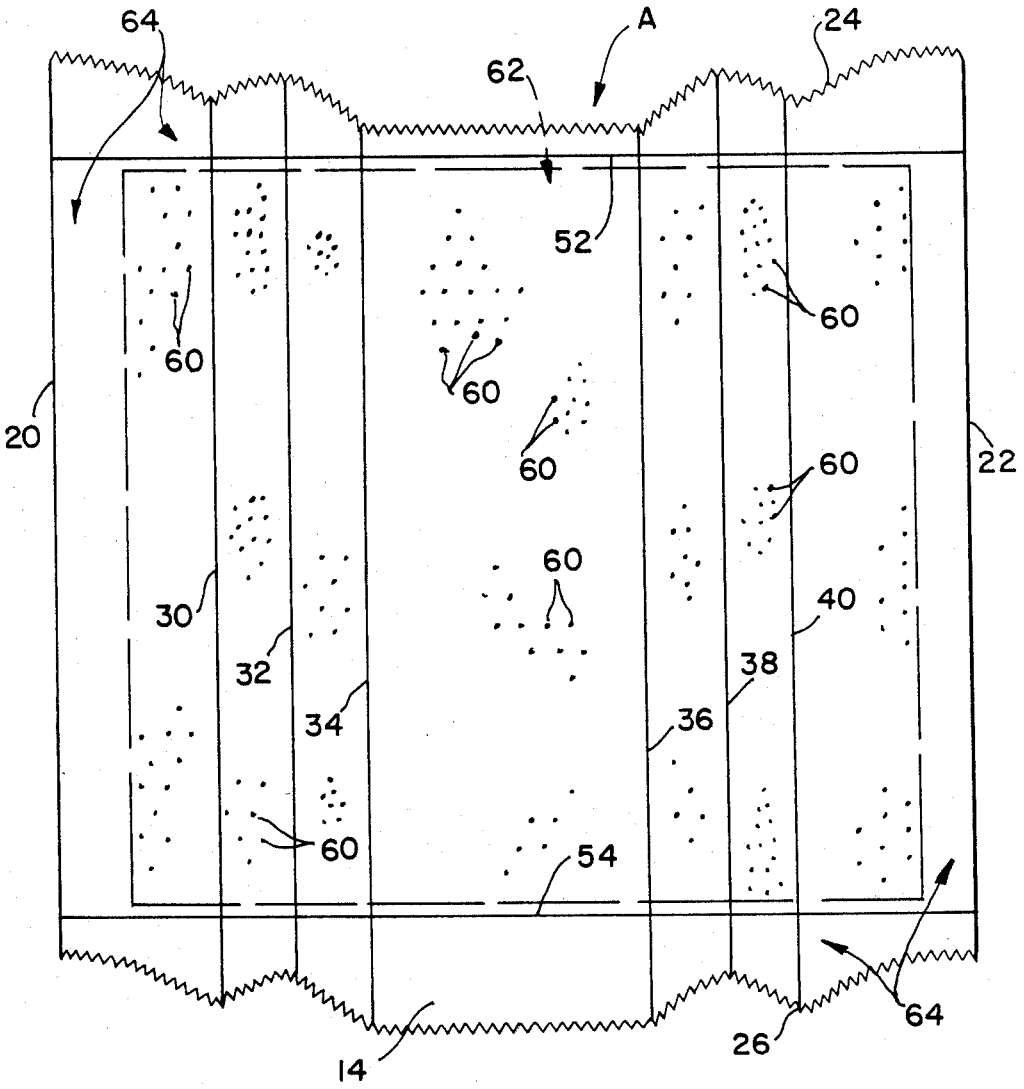
FIG. 1 is a plan view of a multi-layer sheet material formed in accordance with the subject invention prior to folding and securing into a package.
Figure 2:
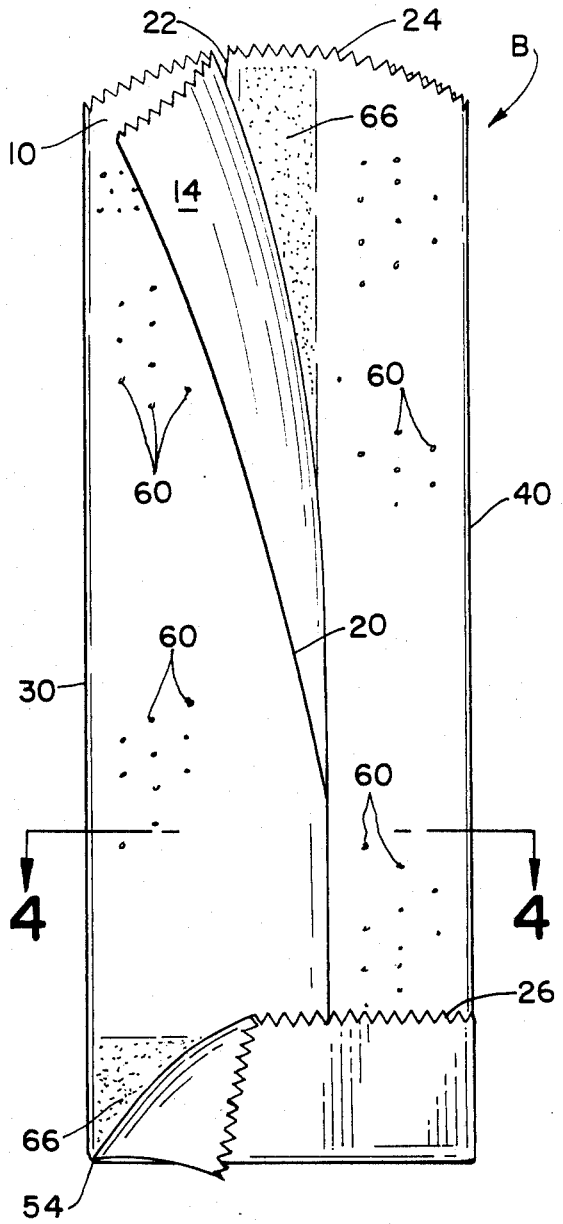
FIG. 2 is a plan view of the folded and secured package.

Referring now to the drawings wherein the showings are for purposes of illustrating the preferred embodiment of the invention only and not for purposes of limiting same, the FIGURES show a multi-layer sheet material A that is folded and secured into an assembled or completed package B for receiving a food product (not shown). The food product enclosed in the package B is adapted to be cooked in a conventional microwave oven.

Figure 4:
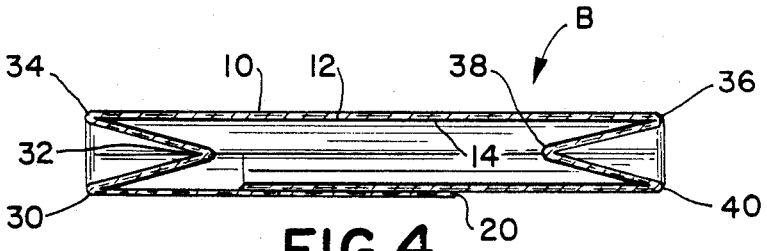
FIG. 4 is a cross-sectional view taken generally along the lines 4—4 of FIG. 2.

More particularly, and with reference to FIGS. 1 and 4, the multi-layer sheet material preferably has three layers of materials. The first layer 10 is a paper such as a bleached kraft paper. A second layer 12 comprises a polyethylene material which receives a third or metallized layer 14. In the preferred embodiment, metallic layer 14 is applied to polyester layer 12 by known vacuum deposition techniques. Thereafter, these two layers are laminated to first layer 10, also by known techniques. The vacuum deposition and lamination techniques to not themselves form a part of the present invention. Inasmuch as they are already known in the art, a detailed description thereof is deemed unnecessary to a full and complete understanding of the subject invention. The metallized polyester is then secured to the first layer to define a laminated product. It will also be appreciated by those skilled in the art that other processes to form a multi-layer material, particularly one in which one of the external surfaces is a metallic layer, may be satisfactorily used without departing from the scope and intent of the subject invention.

The thickness of the metal layer must be monitored since too much metal can adversely react with the microwave. By way of example, the metal layer is measured by known optical means and preferably ranges between 0.19 and 0.26 optical density with a most preferred measurement of approximately 0.23 optical density.

Figure 3:
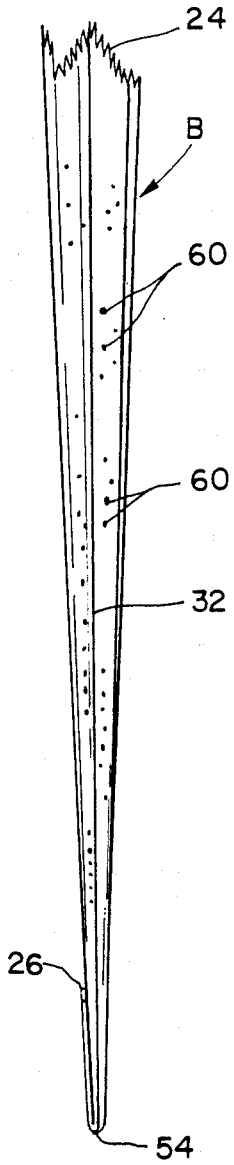
FIG. 3 is a front elevational view of the package of FIG. 2.

The multi-layer sheet material has an irregular periphery 18 defined by generally parallel side edges 20, 22 and scalloped top and bottom edges 24, 26. The top and bottom edges have an irregular, scalloped configuration in order to facilitate folding of the sheet material along parallel, predetermined fold lines 30, 32, 34, 36, 38, and 40. The fold lines 32, 38 are reversed with respect to the remaining fold lines to define an expandable, corrugated-type conformation in the completed package as illustrated in FIG. 3. This corrugated conformation permits the package to be shipped in a planar condition but readily expanded to receive a food product in an interior cavity 50 thereof. Corresponding top and bottom fold lines 52, 54 are provided in generally perpendicular relation to the above described fold lines for selectively closing off top and bottom portions of the package as will become more apparent hereinbelow.

A large number of pinholes 60 are provided in a first or central region 62 to permit the venting or escape of water vapor resulting from cooking a food product in the package. For purposes of the following discussion, pinholes are defined as very small openings and are not restricted to any particular manner of formation. The pinholes are approximately 0.01 inches in diameter and spaced approximately 0.25 inches apart in horizontal rows in the view of FIG. 1. The pinholes in adjacent rows are, in turn, offset from each other to provide a pattern that will yield the most effective venting. The pinholes extend entirely through layers 10, 12, 14 of the sheet material. It will be appreciated, however, that some specific applications of the package may dictate use of slightly larger or smaller pinholes and/or different patterns for the pinholes. Such modifications are deemed to come within the spirit and intent of the subject invention.

A second or peripheral region 64 of the sheet material is absent of any pinholes and adapted to receive means for securing the side edges 20, 22 and top and bottom edges 24, 26 together. According to the preferred arrangement, the securing means is defined by an adhesive 66 that will securely bond the metallic and paper layers together. Particularly, the adhesive is received on the peripheral region 64. Only the peripheral regions of the package are secured together so that the adhesive will not pass or leach into the interior of the completed package.

By way of example, the left-hand edge of the metallic layer 14 is provided with an adhesive in the peripheral region. Likewise, the right-hand portion of the paper layer 10, i.e., the underside as shown, receives adhesive in the peripheral region. The right and left-hand edges are brought toward one another, the sheet material is folded along lines 30, 34, 36, 40, and the metallic layer and paper layer secured together. This disposes the metallic layer 14 along the entire interior surface of the completed package and, likewise, disposes the paper layer along the exterior portion of the completed package. Still further, the top and bottom fold lines 52, 54 are adapted to close off the top and bottom of the interior cavity and maintain a food product therein. In a similar manner, only the peripheral regions 64 of the top and bottom receive any adhesive so that the potential for leakage through the pinholes to the interior of the package is limited.

In manufacturing the subject new microwave package, the multi-layer sheet material A is first prepared. A roll of material is pierced using conventional equipment so that bands of predetermined widths include the pinholes therein disposed in predetermined relation to each other. A conventional bag machine folds and creases the sheet material along selected regions as described above. The package blanks may then be cut from the pierced sheets so that the pinholes are disposed and located therein in the manner shown in FIG. 1. Thereafter, assembly of the package may take place.

The invention has been described with reference to the preferred embodiment. Obviously modifications and alterations will occur to others upon a reading and understanding of the specification. It is intended to include all such modifications and alterations insofar as they come within the scope of the appended claims or the equivalents thereof.

Having thus described the invention, it is now claimed:

1. A package for microwave heating of a food product comprising:

a sheet material having a plurality of pinholes extending completely through said sheet material in a first regional and being absent from said sheet material in a peripheral second region, said pinholes being approximately 0.01 inches in diameter;

means for securing said sheet material so as to define a cavity adapted to receive an associated food product, said securing means being disposed on said sheet material second region to inhibit passage thereof through said pinholes to the cavity.

2. The package as defined in claim 1 wherein said sheet material is a multi-layer construction including a first paper layer defining an exterior portion of the assembled package, a metallic layer defining an interior portion of the assembled package, and an intermediate layer effectively bonding said metallic layer to said paper layer.

3. The package as defined in claim 1 wherein said pinholes are spaced approximately 0.25 inches apart in a first predetermined row and the pinholes in an adjacent second row are offset from those in said first row.

4. A package for microwave heating of a food product comprising:

a multi-layer sheet material including (i) a first paper layer defining an exterior portion of the assembled package;

(ii) a metallic layer defining an interior portion of the assembled package; and, (iii) an intermediate layer effectively bonding said metallic layer to said paper layer;

a plurality of pinholes extending completely through said sheet material, said pinholes being approximately 0.01 inches in diameter and being absent from preselected regions of said sheet material; and, means for securing said sheet material to form an interior cavity, said securing means being disposed on said sheet material preselected regions to inhibit passage through said pinholes.

5. The package as defined in claim 4 wherein said pinholes are spaced approximately 0.25 inches apart in a first predetermined row and the pinholes in an adjacent second row are offset from those in said first row.

6. The package as defined in claim 4 having a first series of generally parallel fold lines to facilitate folding of said sheet material to a predetermined conformation.

7. The package as defined in claim 4 wherein said preselected regions are defined along the peripheral edge of said sheet material.

8. The package as defined in claim 4 wherein said pinholes have substantially the same diameter through each layer of the multi-layer sheet.

* * * * *